US005737996A

United States Patent [19]

Hansen

[11] Patent Number: 5,737,996

[45] Date of Patent: Apr. 14, 1998

[54] HYDRAULIC AXIAL PISTON MACHINE

[75] Inventor: Ove Thorbøøl Hansen, Nordborg, Denmark

[73] Assignee: Danfoss AS, Nordborg, Denmark

[21] Appl. No.: 765,413

[22] PCT Filed: Jun. 30, 1995

[86] PCT No.: PCT/DK95/00279

§ 371 Date: Dec. 26, 1996

§ 102(e) Date: Dec. 26, 1996

[87] PCT Pub. No.: WO96/02758

PCT Pub. Date: Feb. 1, 1996

[30] Foreign Application Priority Data

Jul. 13, 1994 [DE] Germany ..... 44 24 607.2

[51] Int. Cl.[6] ..... F01B 3/00

[52] U.S. Cl. ..... 92/12.2; 92/57; 92/71; 417/269

[58] Field of Search ..... 92/12.2, 57, 71; 417/269; 60/487; 91/499

[56] References Cited

U.S. PATENT DOCUMENTS 2,451,379 10/1948 Burke ..... 92/71

3,169,488 2/1965 Galliger ..... 92/57 X 4,620,475 11/1986 Watts ..... 92/57 X 5,588,347 12/1996 Jepsen ..... 92/12.2

5,678,471 10/1997 Ash, Jr. et al. ..... 92/71

5,685,215 11/1997 Jepsen et al. ..... 92/72 X

*Primary Examiner*—Hoang Nguyen

*Attorney, Agent, or Firm*—Lee, Mann, Smith, McWilliams, Sweeney & Ohlson

[57] ABSTRACT

A hydraulic axial piston machine (1) is disclosed, having a cylinder drum (2), which has at least one cylinder (5) in which a piston (9) is arranged to move back and forth, and having a control plate (3), which on rotation of the cylinder drum (2) and control plate (3) relative to one another connects the cylinder (5), in dependence on its position, to a fluid inlet and a fluid outlet (4), a pressure plate (6) being arranged between the cylinder drum (2) and the control plate (3) and having for each cylinder (5) a fluid path (14) between the control plate (3) and the cylinder drum (2). It is desirable for such a machine to be capable of operation also with a hydraulic fluid that has no or only slight lubricating properties. To that end, the cylinder (5) is lined with a bushing (10) of a friction-reducing plastics material which projects from the cylinder drum (2) and is inserted in the pressure plate (6).

13 Claims, 1 Drawing Sheet

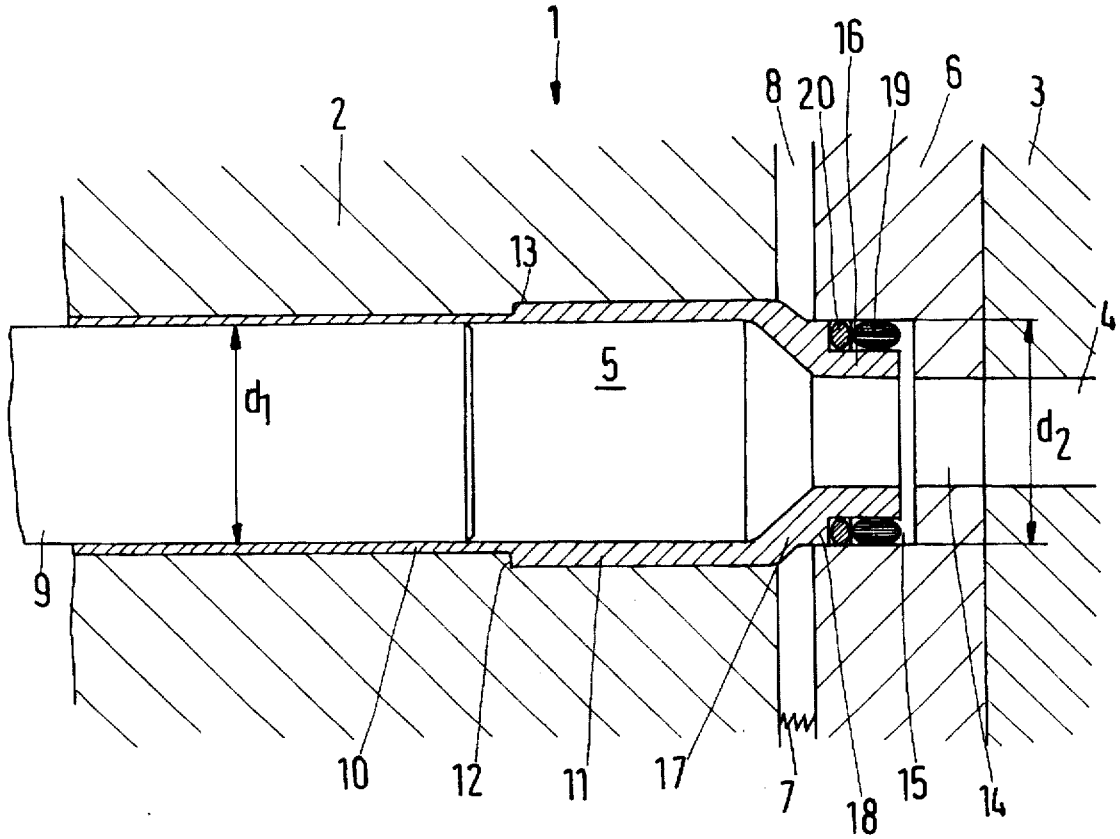
1
2
3
4
5
6
7
8
9
10
11
12
13
14
15
16
17
18
19
20
d1
d2

HYDRAULIC AXIAL PISTON MACHINE

The invention relates to a hydraulic axial piston machine having a cylinder drum, which has at least one cylinder in which a piston is arranged to move back and forth, and having a control plate, which on rotation of the cylinder drum and control plate relative to one another connects the cylinder, in dependence on its position, to a fluid inlet and a fluid outlet, a pressure plate being arranged between the cylinder drum and the control plate and having for each cylinder a fluid path between the control plate and the cylinder drum.

The control counter-plate normally has arcuate or kidney-shaped control slots, one of which is connected to the fluid inlet whilst the other is connected to the fluid outlet. The control plate is oriented such that the inlet is located in a region in which the piston moves away from the control plate, whilst the outlet is located in a region in which the piston moves towards the control plate.

The connection between the control plate and the cylinders should be as fluid-tight as possible, at least on the pressure side. Escaping fluid reduces the volumetric efficiency. This tight seal is achieved in that the pressure plate is pressed as firmly as possible against the control plate (U.S. Pat. No. 4,481,867). The connection between the cylinders; and the pressure plate can be effected by bushings or sleeves, which are inserted in the cylinder and bear against the pressure plate or are constructed in one piece therewith.

Movement of the piston in the cylinder creates friction. This friction is not serious provided that a fluid which has lubricating properties is used as hydraulic fluid. Most hydraulic oils, in particular synthetic hydraulic oils, are designed and are suitable for this purpose. On the grounds of environmental pollution, however, such synthetic hydraulic oils, which are often relatively toxic, are being used with increasing reservation. In order for there to be greater freedom in the choice of hydraulic fluids, that is, in order to be able also to use those fluids which have only slight or even no lubricating properties, such as water, for example, the prior German patent application P 43 01 126 proposed the use of bushings made of a plastics material which co-operates with little friction with the material of the piston. Such bushings, however, can be reliably secured in the cylinder drum only with relatively great difficulty. Often, they are loaded not only by the frictional forces of the piston, but also by the changing pressures of the hydraulic fluid within the cylinder enclosed by the bushing.

The invention is based on the problem of being able to operate a hydraulic axial piston machine of the kind mentioned in the introduction even with hydraulic fluids which have slight or even no lubricating properties, for example, with water.

This problem is solved in a hydraulic axial piston machine of the kind mentioned in the introduction in that the cylinder is lined with a bushing of a friction-reducing plastics material which projects from the cylinder drum and is inserted in the pressure plate.

This construction provides several advantages. Firstly, the piston now slides with little friction in the cylinder. This is caused by the bushing's being formed from a plastics material which co-operates with little friction with the piston, which generally consists of a metal, for example, steel. Examples of plastics materials which may be considered for the bushing or for the bushing layer are, in particular, materials from the group of high-strength thermoplastic plastics materials on the basis of polyaryl ether ketones, in particular polyether ether ketones, polyamides, polyacetals, polyaryl ethers, polyethylene terephthalates, polyphenylene sulphides, polysulphones, polyether sulphones, polyether imides, polyamide imide, polyacrylates, phenol resins, such as novolak resins, or similar substances, and as fillers, use can be made of glass, graphite, polytetrafluoroethylene or carbon, in particular in fibre form. When using such materials, it is possible to use even water as the hydraulic fluid. Because the bushing is inserted in the pressure plate, there is moreover a fluid-tight connection between the pressure plate and the cylinder with no additional parts. The accuracy of manufacture and the seal can be improved accordingly. There is, in fact, no additional sealing point. Furthermore, by this measure, forces can be kept away at least from an end face or at least be controlled so that they are easily manageable.

In a preferred construction, the bushing has a stop member which co-operates in an axial direction with a corresponding counter stop member on the cylinder drum. The bushing is therefore fixed at least in one direction of movement in the cylinder drum. Any further movement of the bushing in the cylinder drum is prevented at the latest when the stop member lies against the counter stop member.

It is here especially preferred for the stop member to be formed by an enlargement of the external diameter of the bushing. Such an enlargement is easy to construct during manufacture of the bushing. For example, the bushing can be cast. In that case, the enlarged external diameter can be produced during the casting process.

It is also preferable for the stop member to be arranged within the cylinder drum. The cylinder drum then absorbs deformation forces which are able to act radially on the bushing. There is thus no danger of the bushing becoming deformed by any forces in such a manner that the stop member is able to slip off over the counter stop member. The bushing can therefore be made of a material which itself is unable to absorb any great forces and, because of this construction, also does not have to.

The bushing preferably has at its pressure plate end an end portion of reduced external diameter. This end portion is then inserted in the pressure plate. The reduced external diameter, with a corresponding reduction in the internal diameter, then contributes to matching the flow path to the control kidneys.

Here, it is preferable for the bushing to have a transitional portion merging into the end portion, the transitional portion being arranged substantially between the cylinder drum and the pressure plate. In the end portion, which is enclosed by the pressure plate, and in the "main portion", which is enclosed by the cylinder drum, forces acting radially on the bushing are absorbed by the pressure plate and the cylinder drum respectively. Any deformation of the bushing is reliably prevented by this means. In the region between the cylinder drum and the pressure plate the bushing is not, however, externally supported. But, as a result of the construction in which the transitional portion is arranged in this region, a component of the bushing wall is obtained which runs in a radial direction. This component is then able to absorb even relatively large radial forces, without the bushing being noticeably deformed in this region.

The transitional portion is preferably of substantially conical construction, at least on its inside. The transitional portion must also provide a flow path enclosed by the bushing to allow the fluid in the cylinder to flow in or out. The conical construction of the transitional portion produces gentle transitions in the fluid path.

The largest external diameter of the end portion which projects into the pressure plate is advantageously of the same order of magnitude as the internal diameter of the bushing at its piston-run portion. The piston-run portion is the region in which the piston moves back and forth. The internal diameter of the piston-run portion corresponds to the external diameter of the piston. This construction produces substantially a pressure equilibrium, that is to say, the pressure of the hydraulic fluid which tries to push the bushing further into the cylinder drum is virtually the same as the pressure which tries to push the bushing out of the cylinder drum. This equilibrium of forces enables the bushing to be reliably retained in the cylinder drum with relatively little effort.

In that case, when there is a difference between the external diameter of the end portion and the internal diameter of the bushing, it is preferred for the stop member to lie against the counter stop member from the side of larger diameter. For reasons connected with manufacturing techniques, in practice the two diameters can be made exactly the same size only with considerable effort. A difference between the two diameters can therefore not only be tolerated but even be deliberately provided. Provided that this difference is relatively small, it causes no additional problems; on the contrary, it provides an opportunity for the bushing to be pressed with its stop member against the counter stop member. The movement of the bushing in the one direction is then prevented by the counter stop member. Movement in the other direction is likewise impossible because of the force distribution produced by the pressure of the hydraulic fluid. Using this simple feature, a stable position of the bushing in the cylinder body is therefore achieved, without relatively complicated fixing measures having to be used. The difference should, as mentioned, be kept small. The force difference need basically only be large enough to enable the frictional forces exerted by the piston on the bushing to be reliably absorbed, that is to say, large enough so that the piston cannot push the bushing out of the cylinder body.

The external diameter of the end portion is preferably larger than the internal diameter of the bushing, and the stop member is formed by the edge of an enlargement in the wall of the bushing. The bushing is therefore inserted from the pressure plate end into the cylinder drum and then always loaded, even in operation, with pressure in such a manner that the forces on the bushing are directed into the cylinder drum. Not only does the enlargement of the wall of the bushing provide in a simple manner a stop member, which is formed by the edge of this enlargement, it also reinforces the bushing in a region which is mainly loaded with pressure during operation, that is, a region over which the piston rarely, if at all, slides. The fluid pressure is not critical, provided that the bushing is surrounded by the cylinder drum. By reinforcing the wall, precautions are also taken against possible deformations occurring at the end projecting from the cylinder drum from being transferred to an appreciable degree to the interior of the cylinder drum.

This is particularly the case if the enlargement continues into the transitional region and, optionally, into the end portion. The risk of deformation is further reduced by this measure.

The end portion preferably has a circumferential sealing stop face which is arranged within the pressure plate. At this sealing stop face, which can preferably also be arranged at the boundary between the transitional region and the end portion, not only is a barrier to movement of the seal or seals provided, but also a defined pressure applying area is created, so that the pressure ratios acting on the bushing can be predetermined relatively accurately.

The invention is described hereinafter with reference to a preferred embodiment in conjunction with the drawings, in which the single FIGURE is a fragmentary view of an axial piston machine in cross-section.

An axial piston machine 1, illustrated purely diagrammatically in a fragmentary view, has a cylinder drum 2 which is mounted so as to rotate with respect to a control plate 3. The control plate has control kidneys 4, only one of which is illustrated. On rotation of the cylinder drum 2 with respect to the control plate 3, the inside of a cylinder 5 is brought into register alternately with one control kidney 4, a so-called inlet kidney, through which fluid is introduced into the cylinders, and with another control kidney, a so-called outlet kidney, through which fluid is able to escape from the cylinder 5. Between the control plate 3 and the cylinder drum 2 there is arranged a pressure plate 6. The pressure plate 6 lies in sliding contact with the control plate 3. It is pressed against the control plate 3 by a diagrammatically illustrated spring 7 between the cylinder drum 2 and the pressure plate 6. This is intended to provide as tight a connection as possible between the control plate 3 and the pressure plate 6, wherein the forces acting on the pressure plate 6 and on the control plate 3 should be as accurately as possible predictable. The spring 7 is arranged in an gap 8 between the cylinder drum 2 and the pressure plate 6.

A piston 9 is arranged in the cylinder 5 so that it moves back and forth. When the piston moves to the left in FIG. 1, fluid is able enter the cylinder 5. If the axial piston machine 1 is being used as a pump, this movement is the suction stroke. If the axial piston machine 1 is being used as a motor, this movement is the working stroke. If the piston moves to the right, this is the pressure stroke in a pump and the exhaust stroke in a motor.

The cylinder is surrounded by a bushing 10. The bushing consists of a plastics material which co-operates with little friction with the material of the piston 9. Materials which may be considered for the bushing are in particular, materials from the group of high-strength thermoplastic plastics materials on the basis of polyaryl ether ketones, in particular polyether ether ketones, polyamides, polyacetals, polyaryl ethers, polyethylene terephthalates, polyphenylene sulphides, polysulphones, polyether sulphones, polyether imides, polyamide imide, polyacrylates, phenol resins, such as novolak resins, or similar substances, and as fillers, use can be made of glass, graphite, polytetrafluoroethylene or carbon, in particular in fibre form. When using such materials, it also possible to use water as the hydraulic fluid.

The distance inside the bushing 10 within which the piston moves is referred to hereinafter as the piston-run portion.

The bushing 10 has a relatively modest wall thickness for most of its length. At the end at which the pressure plate 6 is arranged, it has a portion 11 of enlarged wall thickness. The edge 12 of this portion 11 forms a stop member which co-operates with a counter stop member 13 in the cylinder drum 2. Both stop members are located inside the cylinder drum 2 so that the bushing 10 is supported radially also in the region of its stop member 12 by the cylinder drum 2. In conjunction with the stop member 12, the counter stop member 13 prevents the bushing 10 from being pushed further into the inside of the cylinder drum 2, that is, to the left in the drawing.

The pressure plate 6 has a through-opening 14 by way of which the hydraulic fluid passes from the control kidney 4 into the cylinder 5 or vice versa. At its end facing the cylinder drum 2, the through-opening 14 has an enlargement 15 into which the bushing 10 is inserted. For that purpose, the bushing has an end portion 16, the external diameter of which is reduced with respect to the external diameter of the remaining length of the bushing 10. The wall thickness of the end portion is nevertheless exactly the same size as the wall thickness in portion 11 of the bushing.

The end portion 16 merges by way of a transitional portion 17 into the remainder of the bushing 10. This transitional portion is arranged in the gap 8. In this gap 8 the bushing is not enclosed by a supporting part, for example, the cylinder drum 2 or the pressure plate 6. Since, however, components of the wall of the bushing are directed radially inwards here, by this construction the pressures inside the bushing 10, that is, in the cylinder 5, which arise as a result of hydraulic fluid, can be better absorbed, so that no deformation need be feared.

In the vicinity of the transitional portion 17 the end portion 16 has a stop member 18 which is inserted further into the enlargement 15 of the through-opening 14. An O-ring 19 bears on this stop member 18 through the intermediary of a support ring 20. The O-ring 19 and the support ring 20 effect a tight connection between the bushing 10 and the pressure plate 6.

The bushing has an internal diameter $d_1$ in its piston-run portion. The enlargement 15 of the through-opening 14 has an external diameter $d_2$. These two diameters $d_1$, $d_2$ are selected to be of the same order of magnitude. The pressure of the hydraulic fluid then acts on the bushing in regions of substantially equal area so that the pressure of the hydraulic fluid does not cause relatively large external pressure forces to act on the bushing 10. One will not choose, however, to make these two diameters $d_1$, $d_2$ exactly the same however. Firstly, this is difficult to realize in manufacture. Secondly, by suitable choice, a firm seating of the bushing 10 in the cylinder drum 2 can be ensured. In the present embodiment, $d_2$, for example, is somewhat larger than $d_1$. Accordingly, the force which is pressing the bushing 10 into the inside of the cylinder drum 2 and thus against the counter stop member 13 is greater than the force which is trying to expel the bushing 10 from the cylinder drum 2. In this manner, reliable seating of the bushing 10 in the cylinder drum 2 is achieved with a relatively simple dimensional rule. The size ratios can, of course be reversed. In that case, the bushing 10 would have to be inserted from the other side into the cylinder drum 2, so that the counter stop member 13 is effective with the stop member 12 in the opposite direction.

The transitional portion 17 is of conical construction on its inside, that is, the flow path for the hydraulic fluid widens gradually towards the cylinder 5 so that the flow ratios here are favourable.

I claim:

1. A hydraulic axial piston machine having a cylinder drum having at least one cylinder in which a piston is arranged to move back and forth, and having a control plate, which on rotation of the cylinder drum and control plate relative to one another connects the cylinder, in dependence on its position, to a fluid inlet and a fluid outlet, a pressure plate located between the cylinder drum and the control plate and having for each cylinder a fluid path between the control plate and the cylinder drum, the cylinder being lined with a bushing of a friction-reducing plastics material which projects from the cylinder drum and includes a portion which extends into pressure plate.

2. A machine according to claim 1, in which the bushing has a stop member which co-operates in an axial direction with a corresponding counter stop member on the cylinder drum.

3. A machine according to claim 1, in which the stop member is formed by an enlarged external diameter of the bushing.

4. A machine according to claim 2, in which the stop member is located within the cylinder drum.

5. A machine according to claim 1, in which the bushing includes an end portion of reduced external diameter proximate the pressure plate.

6. A machine according to claim 5, in which the bushing includes a transitional portion merging into the end portion, the transitional portion being located substantially between the cylinder drum and the pressure plate.

7. A machine according to claim 6, in which the transitional portion is of substantially conical construction in at least an inner surface of the transitional portion.

8. A machine according to claim 2, in which a largest external diameter ($d_2$) of the portion which extends into the pressure plate is of the same order of magnitude as an internal diameter ($d_1$) of the bushing at its portion in which the piston extends.

9. A machine according to claim 8, in which, when there is a difference in size between the external diameter ($d_2$) and the internal diameter ($d_1$, the stop member butts against the counter stop member from the direction of the larger of the diameter ($d_1$) and the diameter ($d_2$).

10. A machine according to claim 2, in which an external diameter ($d_2$) of the end portion is larger than an internal diameter ($d_1$) of the bushing, and the stop member is formed by an edge of an enlargement in the wall of the bushing.

11. A machine according to claim 10, in which the enlargement continues into a transitional portion.

12. A machine according to claim 11, in which the enlargement extends into the portion which extends into the pressure plate.

13. A machine according to claim 1, in which the end portion includes a circumferential sealing stop face located within the pressure plate.

* * * * *